United States Patent [19]

Miller

[11] 4,205,402

[45] Jun. 3, 1980

[54] BIDET ADAPTOR FOR TOILET

[76] Inventor: Daniel C. Miller, P.O. Box 7616, San Francisco, Calif. 94120

[21] Appl. No.: 960,907

[22] Filed: Nov. 15, 1978

[51] Int. Cl.[2] ..... A47K 3/22; A47K 11/08

[52] U.S. Cl. ..... 4/448; 4/447

[58] Field of Search ..... 4/6, 7, 1

[56] References Cited

U.S. PATENT DOCUMENTS

| | | | |
|---|---|---|---|
| 2,344,561 | 3/1944 | Popil | 4/7 |
| 2,504,257 | 4/1950 | Dunn | 4/7 |
| 2,528,095 | 10/1950 | Ward | 4/7 UX |
| 2,605,477 | 8/1952 | Monserrat | 4/7 |
| 2,705,495 | 4/1955 | Vrana et al. | 4/7 X |
| 2,957,180 | 10/1960 | McMullen | 4/7 |
| 2,995,759 | 8/1961 | Gentry | 4/7 |
| 3,164,846 | 1/1965 | Foster | 4/7 |
| 3,256,531 | 6/1966 | Arensberg | 4/7 |
| 3,310,813 | 3/1967 | Jonsson | 4/7 |
| 4,135,255 | 1/1979 | Manandaz | 4/7 |

*Primary Examiner*—Henry K. Artis

*Attorney, Agent, or Firm*—Townsend and Townsend

[57] ABSTRACT

A portable device for adapting a toilet for use as a bidet comprises a rigid conduit including a generally straight, horizontal portion sized to fit in the gap between the toilet seat and the toilet bowl rim, and a contiguous U-shaped portion for discharging a column of water upwards. The end of the horizontal conduit portion remote from the U-shaped portion is connected by a water supply line to a convenient bathroom faucet. The horizontal conduit portion is of sufficient length to permit movement of the conduit along the axis of the horizontal conduit portion in order to permit positioning of the upwardly discharging column of water over the bowl at various distances from the rim. Separate diversion means may be provided for discharging the stream of water downwardly into the toilet bowl while maintaining the U-shaped portion in its upwardly open position. In one embodiment, the diversion means comprises a diverter valve and a separate rigid conduit coupled to the diverter valve and sized to fit between the toilet seat and the toilet bowl rim. In another embodiment, the diversion means comprises a deflection plate and carriage means for providing relative movement of the deflection plate and the rigid conduit so that when the upwardly discharging column of water is closest to the bowl rim, the deflection plate overlies the upwardly discharging column of water and deflects it downwardly into the bowl.

14 Claims, 7 Drawing Figures

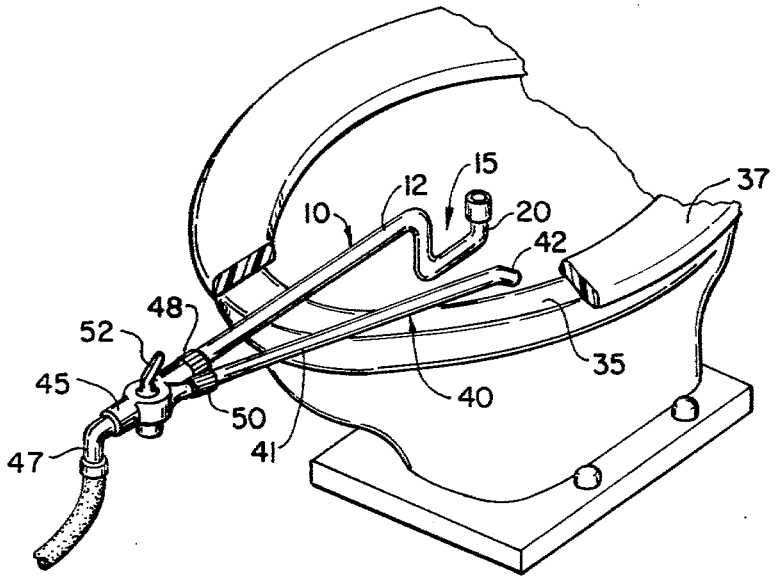
FIG.__2.
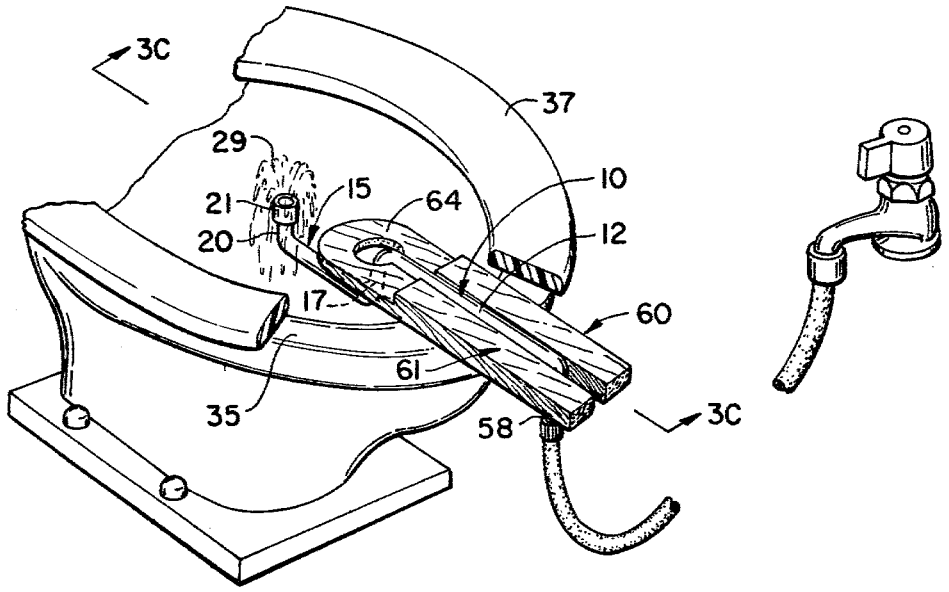
FIG.__3A.

BIDET ADAPTOR FOR TOILET

This invention relates generally to bathroom fixtures, and more specifically to devices for adapting a toilet for use as a bidet.

BACKGROUND OF THE INVENTION

A bidet provides an upwardly discharging column of water beneath a seated user. The use of a bidet is desirable for personal hygiene and medical reasons since the toilet tissue in modern use is only a partial cleaning agent. Urologists and proctologists believe that the incidence of bladder infections and the like could be substantially eliminated if people would make routine use of a bidet in order to cleanse the perineal area. Due to the configuration of the female anatomy, women appear to be more prone to such disorders. Additionally, the bidet may be a useful therapeutic device for promoting healing after surgical operations, such as episiotomies and the like.

It has been common in Western European counties to provide a bidet as a unit separate from the toilet. However, such a unit takes up additional floor space, and requires plumbing that is more elaborate than that of the toilet itself due to the need to provide hot and cold water. In addition, the expense of the bidet itself must be considered.

The above problems can be overcome by a device that would adapt a standard toilet to perform the additional functions of a bidet. The prior art in this area is voluminous, clearly suggesting that many people believe the idea to be a good one. Most of the prior art devices are relatively elaborate devices that are attached to the toilet bowl in question in such a manner that they tend to be substantially non-removable. It is clear that a substantially permanently attached device interferes with normal usage of the toilet no matter how unobtrusive the device is designed to be, and further interferes with cleaning of the toilet. Additionally, a bidet adapter that resides permanently on the toilet is easily contaminated by body wastes, thereby largely defeating a major purpose for which the device is used in the first place. Furthermore, such fixed devices are in general not readily adjustable as to position and further may not be readily adaptable to more than a narrow range of toilet bowl configurations.

There have been a number of portable bidet adapters, some of which are suitable for a wide range of toilet bowl configurations. Such portable bidet adapters often depend on a faucet in the bathroom to provide a source of water at a proper temperature and pressure. A water supply line is typically connected to the faucet by means of a suitable connector which may be held to the faucet by friction or by positive means (e.g. threads).

However, even these prior art devices have not been entirely satisfactory, since they have generally been either non-adjustable once in place, or difficult to adjust by a user sitting on the toilet seat. A further problem arises from the occasional need to temporarily interrupt the discharging column of water. Turning off the water faucet would necessitate a readjustment to achieve the desired pressure and temperature while placing an on/-off valve in the bidet adapter supply line at a location convenient to the user may be impractical when a friction fit faucet connector is used, since such a connector might not hold under the pressure caused by closing off the line at a downstream point.

Efforts to design a bidet adapter that is simple and inexpensive to manufacture, easy to position and adjust, and whose upward discharge of water may be easily and conveniently interrupted, have in general been unsuccessful to date. As a result, bidet adapters have not become commonly used and their potential advantages have remained largely unrealized.

SUMMARY OF THE INVENTION

The present invention provides a portable device for adapting a toilet for use as a bidet. The device is of simple construction and may be easily adjusted by a user to provide precise positioning over the toilet bowl. The device provides an upwardly discharging column of water that may be easily and conveniently interrupted.

Broadly, a bidet adaptor constructed according to the present invention comprises a rigid conduit including a generally straight, horizontal portion sized to fit in the gap between the bottom surface of the toilet seat and the top surface of the toilet bowl rim, and a generally U-shaped portion having a segment extending downwardly from an end of the horizontal portion and an upwardly open end for upwardly discharging a column of water. A nozzle may be fitted to the upwardly open end. The end of the horizontal conduit portion remote from the U-shaped portion is connected to a water supply line, typically a flexible hose which may be connected to a convenient bathroom faucet by any suitable removable connector. The horizontal conduit portion is of sufficient length to permit movement of the adaptor along the axis of the horizontal conduit portion in order to permit positioning of the upwardly discharging column of water over the bowl at various distances from the rim, thereby accommodating a wide variety of toilet bowl and/or user configurations.

According to one aspect of the present invention, the U-shaped conduit portion is configured to fit over the toilet bowl rim when the device is inverted, thereby discharging a stream of water in a downward direction so that the user may conveniently adjust the temperature and pressure of the stream of water prior to actual use without having to remain at the toilet to hold the device.

According to a further aspect of the present invention, separate diversion means is provided for discharging the stream of water downwardly into the toilet bowl while maintaining the U-shaped conduit portion in its upwardly open position. In one embodiment, the diversion means comprises a diverter valve and a separate rigid conduit coupled to the diverter valve and sized to fit between the toilet seat and the toilet bowl rim. The separate conduit has an end remote from the diverter valve that is downwardly opening when the U-shaped conduit portion is positioned in its upwardly opening configuration. A user need merely actuate the diverter valve to select which of the two conduits the water is to flow through. The two conduits are spaced apart to provide stabilization.

In another embodiment, the diversion means comprises a deflection plate and carriage means for providing relative movement of the deflection plate and the rigid conduit so that when the conduit is pushed to a position with the upwardly discharging column of water closest to the bowl rim, the deflection plate overlies the upwardly open end of the U-shaped conduit portion and deflects the upwardly discharging column of water downwardly into the bowl. The carriage means is preferably defined by a channelled member having paired elongate portions extending on opposite sides of the horizontal conduit portion, and a connecting web which defines the channel bottom. The channel is sized to accommodate sliding movement of the horizontal portion of the conduit, the bottom of the channel being slotted to provide clearance for the downwardly extending segment of the U-shaped conduit portion and to facilitate disassembly of the adaptor. In this configuration, the deflection plate bridges the two elongate portions of the channelled member at a position over the bowl. The deflection plate has a top surface which is preferably lower than the top surface of the remaining portions of the channelled member, thereby defining a vertical surface which serves as a dam to prevent water that may splash down on the top of the deflection plate from running along the top surface of the remaining portions of the channelled member. Vertical stabilization of the conduit may be enhanced by the provision of a second downwardly extending conduit portion between the horizontal conduit portion and the water supply line, with the channel bottom being further slotted. Alternately, a horizontal transverse member across the top of the horizontal portion may be provided.

For a further understanding of the nature and advantages of the invention, reference should be had to the ensuing detailed description taken in conjunction with the accompanying drawings.

BRIEF DESCRIPTION OF THE DRAWINGS

FIG. 2 is an isometric view of a further embodiment of the invention in which a diverter valve allows the user to selectively direct the water upwardly, or downwardly into the bowl;

FIG. 3*a* is an isometric view of yet a further embodiment of the invention having an overlying, relatively slideable deflection plate;

DESCRIPTION OF THE PREFERRED EMBODIMENTS

Figure 1A:
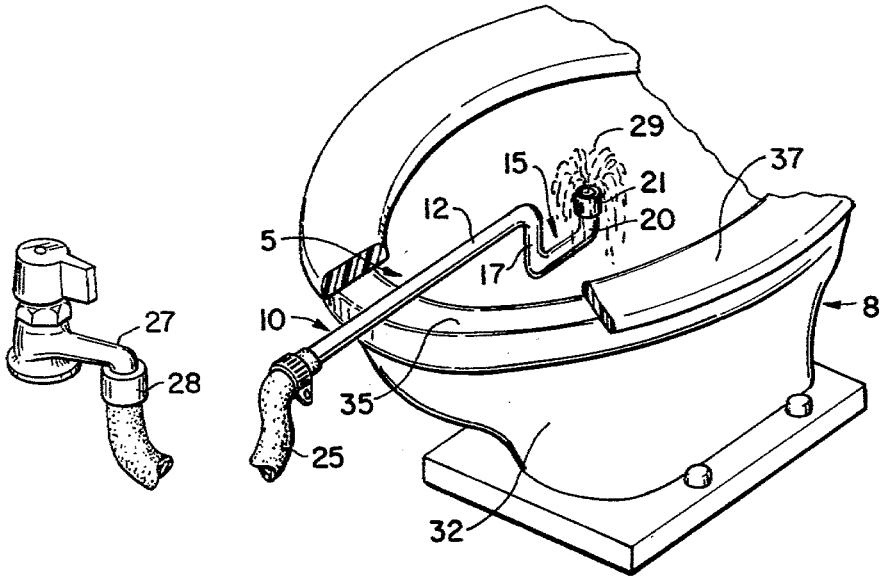
FIG. 1*a* is an isometric view of a bidet adaptor according to the present invention, illustrating the relationship between the adaptor and a toilet bowl.

FIG. 1*a* is an isometric view of a bidet adaptor 5 constructed according to the teachings of the present invention, and shows the relationship between adaptor 5 and a toilet 8. Broadly, adaptor 5 comprises a rigid conduit 10 including a generally straight horizontal portion 12 and a U-shaped portion 15. Conduit 10 is preferably constructed of metal, but other rigid materials such as plastic may be suitable. U-shaped portion 15 includes a normally downwardly extending conduit segment 17 contiguous with horizontal portion 12, and an upwardly extending conduit segment 20. Conduit segment 20 preferably terminates in an upwardly opening nozzle 21 of conventional design. Horizontal portion 12 defines an axis, and directional references to longitudinal movement in the remainder of this description are to be taken as meaning movement along this axis. A flexible hose 25 is connected to an end of horizontal portion 12 remote from U-shaped portion 15. Flexible hose 25 is connected to a convenient faucet 27, preferably of the temperature-mixing variety, by a faucet connector 28. Connector 28 may be of any suitable design for connecting to the available faucet, but it is anticipated that in many cases the faucet is unthreaded and requires that adaptor 28 be of the friction fit variety. When faucet 27 is turned on, water flows through hose 25 and conduit 10, issuing from nozzle 21 as an upwardly discharging column 25.

Adaptor 5 is used in connection with toilet 8 of standard manufacture. Toilet 8 typically comprises a bowl 32 having an upper peripheral rim 35, and a seat 37, shown partially cutaway, overlying bowl rim 35 and spaced apart therefrom by a predetermined gap. The gap is typically maintained by a plurality of rubber bumpers on the underside of seat 37. For clarity, and further since the rubber bumpers are typically situated on the cutaway portion of the seat, they are not illustrated. Horizontal conduit portion 12 has a transverse dimension generally less than the predetermined gap spacing so that portion 12 fits within the gap and is free to slide longitudinally. In this way, nozzle 21 may be caused to assume positions of varying distance from bowl rim 35 to accommodate a variety of toilet bowls and/or user requirements.

Figure 1B:
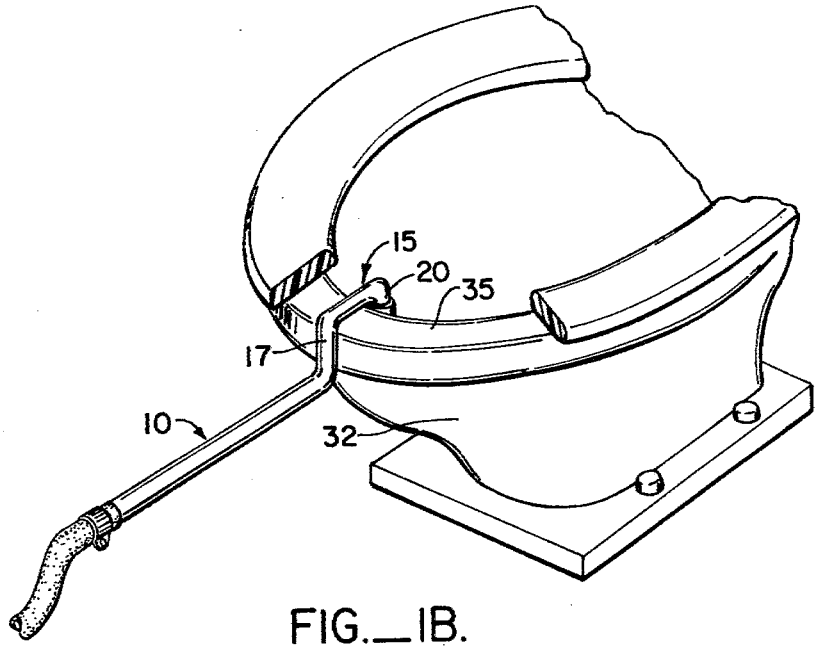
FIG. 1*b* is an isometric view of the adaptor of FIG. 1 in a position allowing a user to adjust the stream of water prior to use.

According to one aspect of the present invention, conduit segments 17 and 20 are spaced apart by a distance approximately equal to the thickness of bowl rim 35 so that adaptor 5 may be inverted with U-shaped conduit portion 15 hooked over rim 35. This is shown in FIG. 1*b*. In such a position, normally upwardly opening nozzle 21 opens downwardly so that water is downwardly discharged into bowl 32. The user may then adjust the temperature and pressure of the liquid stream without having to hold adaptor 5 in position. Once the stream is suitably adjusted, the user may invert adaptor 5 and make use of upwardly flowing column of water 29 as desired.

According to another aspect of the present invention, the liquid may be caused to issue downwardly without having to invert the device. Two further embodiments of the invention incorporating this feature are illustrated at FIGS. 2 and 3*a–d*. Where appropriate, reference numerals corresponding to those in FIG. 1*a* will be used.

FIG. 2 is an isometric view of the first of such further embodiments. In addition to conduit 10, the embodiment of FIG. 2 includes a second rigid conduit 40 having a generally horizontal portion 41 and a contiguous downwardly opening portion 42. A diverter valve 45 has an inlet 47 and outlets 48 and 50. Outlet 48 communicates to the end of horizontal conduit portion 12 remote from U-shaped conduit portion 15 while outlet 50 communicates to an end of horizontal conduit portion 40 remote from downwardly extending conduit portion 42. A valve handle 52 or similar manually-actuable means permits the user to cause water flowing into inlet 47 to flow either through outlet 48 or outlet 50, depending on the position of the handle. Accordingly, the water may be caused to flow through either of conduits 10 and 40.

The vertical cross sectional dimensions of horizontal conduit portions 12 and 41 are no greater than the predetermined gap spacing to permit a sliding fit of the adapter between rim 35 and seat 37. Portions 12 and 41 are spaced apart to provide stabilization whereby conduit segment 20 remains in its upwardly opening position without requiring the user to maintain a hold on the adaptor.

FIG. 3*a* is an isometric view of the other of the two further embodiments of the present invention. In this embodiment, rigid conduit 10 includes horizontal portion 12 and U-shaped portion 15 as in the embodiments of FIGS. 1*a* and 2, and further includes a downwardly extending portion 58 near the end of portion 12 remote from U-shaped portion 15. Conduit 10 is captured by and cooperates with a channeled member 60 which serves two functions. First, member 60 constrains horizontal conduit portion 12 to permit longitudinal but not transverse movement of conduit 10. Second, member 60 deflects upwardly discharging liquid column 29 downwardly when conduit 10 is moved to a position with U-shaped portion 15 proximate bowl rim 35. Member 60 is sandwiched between toilet seat 37 and bowl rim 35 and extends generally horizontally. Member 60 has a channel element 61, preferably slightly thicker than the predetermined gap between seat 37 and rim 35, and a plate element 64, preferably thinner than channel element 61, disposed over bowl 32. Member 60 may be constructed of any relatively rigid, relatively nonporous material such as plastic, hard rubber, varnished wood or metal.

Figure 3C:
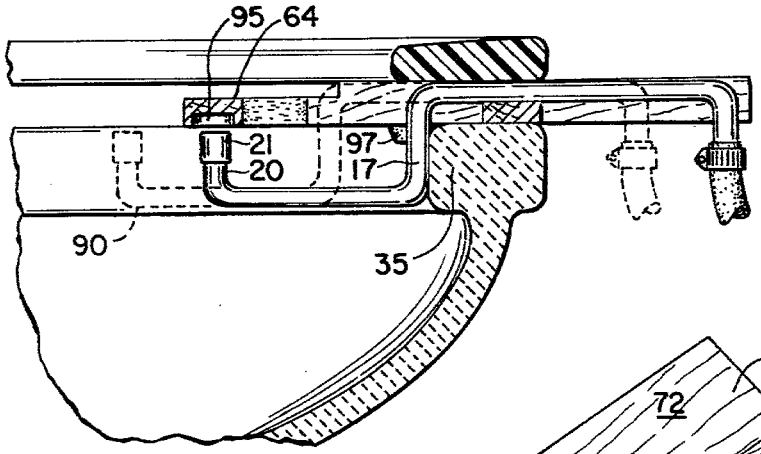
FIG. 3*c* is a sectional view along line 3*c*—3*c* of FIG. 3*a;*.
Figure 3B:
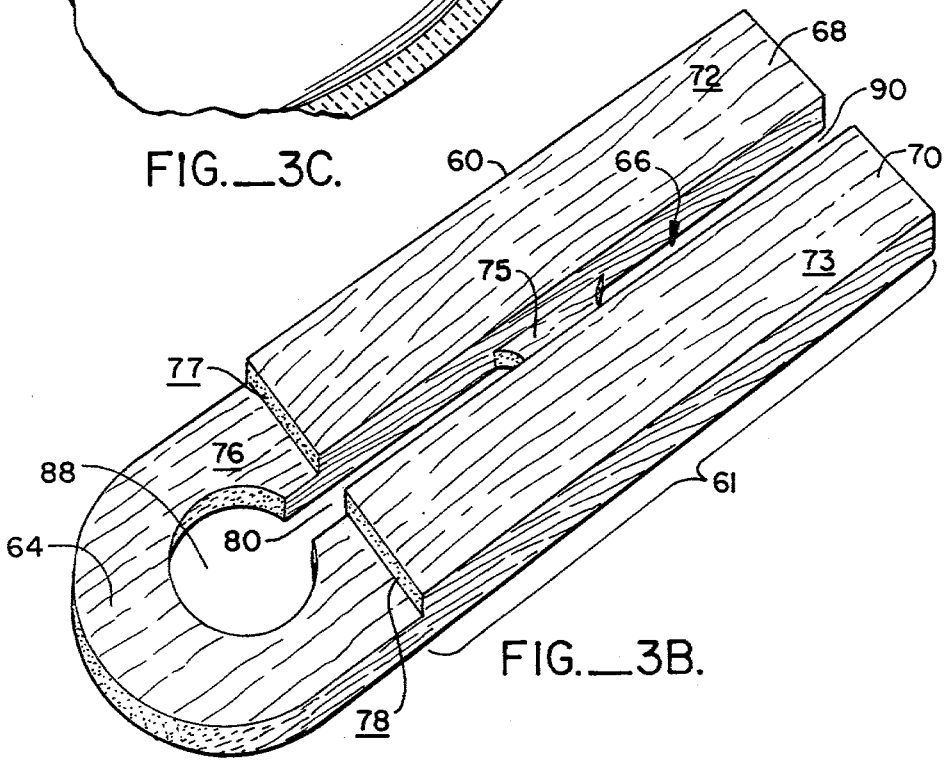
FIG. 3*b* is an isometric view of the slotted channeled member of FIG. 3*a;*

FIG. 3*b* is an isometric view of member 60, illustrating its preferred construction. Channel element 61 has a medial channel 66 of a width and depth to accommodate horizontal conduit portion 12 of conduit 10 when member 60 is placed between seat 37 and rim 35. Channel 66 is defined by paired elongate channel sides 68 and 70 having respective upper surfaces 72 and 73, and an intermediate connecting web 75 serving as a channel bottom. Plate element 64 is bounded by an upper surface 76 which is below upper surfaces 72 and 73 of channel element 61, thereby defining respective generally vertical surfaces 77 and 78. Web 75 does not extend the entire length of channel sides 68 and 70, but rather terminates to provide a slotted channel. A first longitudinally extending slot 80 extends from web 75 toward and partially into plate element 64. Slot 80 is preferably widened into a generally circular opening 88 in plate element 64, opening 88 being sized to accommodate nozzle 21. The overall length of slot 80 is such to allow U-shaped conduit portion 15 to pass therethrough. Slot 80 then accommodates motion of downwardly extending segment 17 as conduit 10 is moved longitudinally within channel 64. A second slot 90 extending all the way to the end of channel element 61 remote from plate element 64 accommodates movement of downwardly extending conduit portion 58.

Referring also to FIG. 3*c*, a sectional view along line 3*c*–3*c* of FIG. 3*a*, plate element 64 is provided on its lower surface with a downwardly opening depression 95. Each of channel sides 68 and 70 carries a rubber foot 97 on its lower surface, rubber feet 97 being located between web 78 and plate element 64.

Referring to FIGS. 3*a* and 3*c*, the operation of the invention may be understood. In use, member 60 is sandwiched between seat 37 and rim 35 with plate element 64 positioned over bowl 32. Proper positioning is established by butting rubber feet 97 against the inner edge of rim 35. Member 60 is snugly held in this position. As is best seen in FIG. 3*c*, the relative dimensions are such that once member 60 is so positioned, nozzle 21 is located directly under downwardly facing opening 95 in plate element 64 when downwardly extending segment 17 is also adjacent the inner durface of rim 35. With conduit 10 so located, the upwardly issuing column of water is deflected downwardly by plate element 64 into bowl 32. When the user desires to make use of the water, he slides conduit 10 within channel 66 to a position shown in phantom in FIG. 3*c*. In the event that some of the water splashes on plate element 64, it is prevented from going beyond the confines of bowl 32 by vertical surfaces 77 and 78. The water runs down into bowl 32 by flowing through opening 88 and portions of slot 80.

It should be noted that downwardly extending conduit segment 17 and downwardly extending conduit portion 58 cooperate with channel side portions 68 and 70 to provide vertical stabilization of conduit 10. While segment 17 would provide adequate stabilization over most of the sliding range, it would not provide the needed stabilization when it was longitudinally opposite opening 88. In that position, downwardly extending portion 58 provides the stabilization.

Figure 3D:
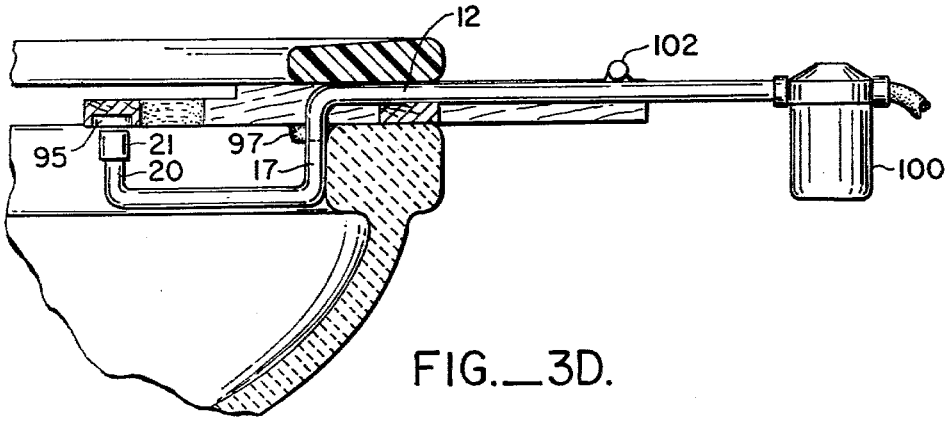
FIG. 3*d* is a sectional view of a variation of the embodiment of FIG. 3*a*.

FIG. 3*d* is a sectional view of an alternate stabilization mechanism where it is desired to avoid downwardly extending conduit segment 58. This would occur where it is desired to attach a syphon device for mixing soap or medication with the stream of water, such a device being shown schematically at 100. Accordingly, horizontal conduit portion 12 carries a transverse member 102 extending across its top and generally contacting upper surfaces 72 and 75 of channel side portions 68 and 70, thereby preventing rotation about the axis of horizontal portion 12.

It can thus be seen that the present invention provides a portable bidet adaptor that is simple to make and easy to use. The adaptor may be adjusted to provide precise positioning of the water column, and the upward flow may be conveniently diverted downward.

While the above provides a full and complete disclosure of the preferred embodiments of the invention, various modifications, alternate constructions, and equivalents may be employed without departing from the true spirit and scope of the invention. For example, member 60 could be constructed without web 78, a single slot extending almost the entire length. Therefore, the above description and illustrations should not be construed as limiting the scope of the invention, which is defined by the appended claims.

What is claimed is:

1. A portable bidet adaptor for use with a toilet having a bowl, a peripheral rim of a predetermined thickness along an upper region of the bowl, and a seat, with the seat overlying the rim of the bowl and spaced apart therefrom by a predetermined gap spacing, comprising:

rigid conduit means having a generally horizontal portion defining an axis and sized to fit between the seat and the rim, and a generally U-shaped portion, the U-shaped portion having first and second normally vertical segments, the first vertical segment extending downwardly from a first end of the horizontal portion and the second vertical segment being normally upwardly open at one end for discharging in an upward column liquid that is flowed through the horizontal portion;

the horizontal portion being sufficiently long in relation to the predetermined thickness of the rim and substantially free of vertical projections beyond the predetermined gap spacing to freely slide to provide movement of the upwardly open end toward and away from the rim;

the first and second normally vertical segments being generally parallel and spaced apart by a distance substantially equal to the predetermined thickness of the bowl rim so that the U-shaped portion may be hooked over the rim to direct the column of water downward upon rotation of the conduit, thereby allowing a user to adjust temperature and pressure of the liquid without having to hold the conduit in position.

2. The invention of claim 1 wherein the horizontal portion is generally tubular and of a cross sectional diameter no greater than the predetermined gap spacing to permit rotation about the axis of the horizontal portion whereby the column of liquid may be directed downwardly.

3. A portable bidet adaptor for use with a toilet having a bowl, a peripheral rim of predetermined thickness along an upper region of the bowl, and a seat, with the seat overlying the rim of the bowl and spaced apart therefrom by a predetermined gap spacing, comprising:

rigid conduit means having a generally horizontal portion defining an axis and sized to fit between the seat and the rim, and a generally U-shaped portion, the U-shaped portion having first and second normally vertical segments, the first vertical segment extending downwardly from a first end of the horizontal portion and the second vertical segment being normally upwardly open at one end for discharging in an upward column liquid that is flowed through the horizontal portion;

the horizontal portion being sufficiently long in relation to the predetermined thickness of the rim and substantially free of vertical projections beyond the predetermined gap spacing to freely slide to provide movement of the upwardly open end toward and away from the rim;

means for downwardly directing the liquid into the bowl while maintaining the second vertical segment in the upwardly open position; and means associated with the means for downwardly directing the liquid for stabilizing the conduit means to maintain the second vertical segment in a vertical orientation.

4. The invention of claim 1 also comprising means for downwardly directing the liquid into the bowl while maintaining the second vertical segment in the upwardly open position.

5. The invention of claim 4 or 3 comprising, in addition to the first mentioned conduit means, second conduit means having a normally downwardly open end disposed over the bowl, the means for downwardly directing the liquid being defined by the second conduit means and a diverter valve having inlet means for receiving liquid and means for selectively directing the liquid into one of the first mentioned and second conduit means.

6. The invention of claim 4 or 3 wherein the means for downwardly directing the liquid comprises a plate member, the conduit means and the plate member being relatively moveable and adapted to assume a position with the plate member overlying and slightly spaced above the upwardly open end of the second vertical segment to deflect the column of liquid downwardly into the bowl.

7. A portable bidet adaptor for use with a toilet having a bowl, a peripheral rim along the upper region of the bowl, and a seat adapted to overlie the rim in spaced relationship therefrom by a predetermined gap, comprising:

a first rigid conduit having a generally horizontal straight portion and a generally U-shaped portion at an end thereof, the U-shaped portion having an upwardly opening end segment for discharging liquid in an upward column of water when pressurized liquid is introduced into the horizontal straight portion, the horizontal portion being sized to fit within the predetermined gap spacing;

a second rigid conduit having a horizontal portion and a downwardly open portion contiguous therewith, the horizontal portion of the second conduit being sized to fit within the predetermined gap spacing; and a diverter valve having means for receiving liquid and for selectively directing the liquid into one of the first and second conduits;

wherein the horizontal portions of the first and second conduits are spaced apart to vertically stabilize the upwardly opening end segment and the downwardly open portion while allowing motion of the upwardly opening end segment toward and away from the rim to permit adjustment of the location of the upwardly discharging column of liquid.

8. A portable bidet adaptor for use with a toilet having a bowl, a peripheral rim along the upper region of the bowl, and a seat adapted to overlie the rim in spaced relationship therefrom, comprising:

a conduit having a generally horizontal straight portion defining an axis and a generally U-shaped portion at an end thereof, the U-shaped portion having a downwardly extending segment and an upwardly opening end segment for discharging liquid in an upward column when pressurized liquid is introduced into the horizontal straight portion;

carriage means for allowing longitudinal motion of the horizontal straight portion along the axis while preventing horizontal transverse motion of the horizontal straight portion perpendicular to the axis when the horizontal straight portion is placed in the gap between the toilet seat and the rim; and horizontally extending deflection means overlying the upwardly open end segment when the conduit assumes a position with the downwardly extending segment proximate the rim, whereby the upwardly flowing column of liquid is diverted downwardly into the toilet bowl.

9. The invention of claim 8 wherein the carriage means is defined by a horizontally extending member having a medial channel sized to accommodate the horizontal portion of the conduit, the channel having a slot in its bottom to accommodate the downwardly extending segment of the U-shaped portion of the tubing when the conduit is moved along the axis defined by the horizontal portion, and wherein the deflection means extends across the channel.

10. The invention of claim 8 wherein the carriage means and the deflection means together comprise:

first and second elongate members extending parallel to the horizontal straight portion of the conduit on opposite sides thereof, the first and second elongate members having respective thicknesses no less than the vertical dimension of the horizontal portion and sized to fit between the toilet seat and the rim with an end thereof disposed over the bowl; and a connecting member joining the elongate members at a position over the bowl, the connecting member extending above the upwardly open end segment to deflect liquid issuing therefrom in a downward direction when the conduit is moved longitudinally to a position with the downwardly extending segment proximate the rim.

11. The invention of claim 10 wherein the connecting member has an upper surface that is below an upper surface of the first and second elongate members, thereby defining a vertical surface such that water splashing down on the connecting portion is prevented by the vertical surface from running along the upper surface of the elongate members.

12. A portable bidet adaptor for use with a toilet having a bowl, a peripheral rim along the upper region of the bowl, and a seat adapted to overlie the rim and spaced relationship therefrom by a predetermined gap comprising:

a conduit having a generally horizontal straight portion defining an axis and a generally U-shaped portion at an end of the horizontal straight portion, the U-shaped portion having a downwardly extending segment and an upwardly opening end segment for discharging liquid in an upward column when pressurized liquid is introduced into the horizontal straight portion;

first and second elongate members extending parallel to the horizontal straight portion of the conduit on opposite sides thereof, the first and second elongate members having respective thicknesses no less than the vertical dimension of the horizontal conduit portion and sized to fit between the toilet seat and the rim with an end thereof disposed over the bowl; and a connecting member joining the elongate members at a position over the bowl, the connecting member extending above the upwardly open end segment to deflect liquid issuing therefrom in a downward direction when the conduit is moved along the axis to a position with the downwardly extending segment proximate the rim, the connecting member having an upper surface that is below an upper surface of the first and second elongate members to define a vertical surface to prevent liquid splashing down on the upper surface of the connecting member from running along the upper surface of the elongate members.

13. A portable bidet adaptor for use with a toilet having a bowl, a peripheral rim of predetermined thickness along an upper region of the bowl, and a seat, with the seat overlying the rim of the bowl and spaced apart therefrom by a predetermined gap spacing, comprising:

rigid first conduit means having a generally horizontal portion defining an axis and sized to fit between the seat and the rim, and a generally U-shaped portion, the U-shaped portion having first and second normally vertical segments, the first vertical segment extending downwardly from a first end of the horizontal portion and the second vertical segment being normally upwardly open at one end for discharging in an upward column liquid that is flowed through the horizontal portion;

the horizontal portion being sufficiently long in relation to the predetermined thickness of the rim and substantially free of vertical projections beyond the predetermined gap spacing to freely slide to provide movement of the upwardly open end toward and away from the rim;

second conduit means having a normally downwardly open end disposed over the bowl; and a diverter valve having inlet means for receiving liquid and means for selectively directing the liquid into one of the first and second conduit means.

14. A portable bidet adaptor for use with a toilet having a bowl, a peripheral rim of predetermined thickness along an upper region of the bowl, and a seat, with the seat overlying the rim of the bowl and spaced apart therefrom by a predetermined gap spacing, comprising:

rigid conduit means having a generally horizontal portion defining an axis and sized to fit between the seat and the rim, and a generally U-shaped portion, the U-shaped portion having first and second normally vertical segments, the first vertical segment extending downwardly from a first end of the horizontal portion and the second vertical segment being normally upwardly open at one end for discharging in an upward column liquid that is flowed through the horizontal portion;

the horizontal portion being sufficiently long in relation to the predetermined thickness of the rim and substantially free of vertical projections beyond the predetermined gap spacing to freely slide to provide movement of the upwardly open end toward and away from the rim; and a plate member wherein the conduit means and the plate member are relatively moveable and adapted to assume a position with the plate member overlying and slightly spaced above the upwardly open end of the second vertical segment to deflect the column of liquid downwardly into the bowl.

* * * * *